United States Patent [19]

Uchida

[11] 4,221,103

[45] Sep. 9, 1980

[54] PACKAGING PAPER CUTTING MECHANISM FOR COIN PACKAGING MACHINE

[75] Inventor: Isamu Uchida, Tokyo, Japan

[73] Assignee: Laurel Bank Machine Co., Ltd., Tokyo, Japan

[21] Appl. No.: 961,918

[22] Filed: Nov. 20, 1978

[51] Int. Cl.[2] ..... B65B 11/04

[52] U.S. Cl. ..... 53/212

[58] Field of Search ..... 53/587, 211, 212; 225/106; 133/1 A, 8 A

[56] References Cited

U.S. PATENT DOCUMENTS

| | | | |
|---|---|---|---|
| 3,821,917 | 7/1974 | Hatanaka | 53/212 X |
| 3,899,869 | 8/1975 | Vehida | 53/212 |
| 4,138,834 | 2/1979 | Nobuhiro | 53/212 |

*Primary Examiner*—John Sipos
*Attorney, Agent, or Firm*—Fleit & Jacobson

[57] ABSTRACT

A packaging paper cutting mechanism for use with a coin packaging machine, in which the setting position of a cutter is changed in accordance with the diameter of coins to be packaged so as to adjust the spacing between the cutter and a plurality of packaging rollers so that the cutting length of rolled packaging paper can be selected to a proper value. A pair of rollers for guiding the packaging paper is made movable together with the cutter so as to guide the packaging paper, while maintaining its preset satisfactory angle with respect to the cutter, even when the cutter is to be moved in accordance with the desired cutting length. Thus, the packaging paper can be cut easily and reliably at all times.

7 Claims, 4 Drawing Figures

PACKAGING PAPER CUTTING MECHANISM FOR COIN PACKAGING MACHINE

BACKGROUND OF THE INVENTION

1. Field of the Invention

The present invention relates to a coin packaging machine, and more particularly to improvements in a packaging paper cutting mechanism for use with the coin packaging machine.

2. Description of the Prior Art

There has been proposed a coin packaging machine which is operative to produce a package of coins by winding packaging paper on the circumferences of a pile of coins and then by closing the packaging paper tight at its both side ends. In the coin packaging machine of this kind, the packaging paper is unrolled to a preset length by means of let-off rollers and is guided onto the circumferences of the piled coins so that it may be wound on the piled coins by means of packaging rollers. The packaging paper is pulled under tension between the let-off rollers and the packaging rollers, when it is to be wound on the piled coins by the actions of the packaging rollers. As a result, the packing paper is straightened and forced onto the edge of a cutter so that it is automatically cut at the cutter edge. One of the most important factors to be considered to ensure the cutting operation is the angle, at which the packaging paper abuts against the cutter edge. If, on the other hand, the diameter and/or thickness of the coins are varied in accordance with the kind of the coins, then it is necessary to change the length and/or width of the paper to be used for the packaging operation. With this in mind, therefore, in order to change the cutting length of the packaging paper, the position of the cutter is shifted to adjust the cutting length.

Since, however, the let-off rollers are fixed stationary at preset positions, the let-off position of the packaging paper is accordingly fixed at a preset position. As a result, when the position of the cutter is shifted to adjust the cutting length of the packaging paper, the relative positions of the let-off rollers to the cutter are changed to make the cutting angle of the packaging paper more obtuse so that the paper cannot be cut to a satisfactory extent.

SUMMARY OF THE INVENTION

It is therefore a primary object of the present invention to provide a packaging paper cutting mechanism for use with a coin packaging machine, which is free from the drawback concomitant with the prior art.

Another but major object of the present invention is to provide a packaging paper cutting mechanism of the above type, in which a pair of rollers for guiding the packaging paper is made movable together with a cutter so as to guide the packaging paper, while maintaining its preset satisfactory angle with respect to the cutter, even when the cutter is to be moved in accordance with the desired cutting length of the packaging paper, so that the packaging paper can be cut easily and reliably at all times.

According to a major aspect of the present invention, there is provided a packaging paper cutting mechanism for use with a coin packaging machine, in which the setting position of a cutter is changed in accordance with the size of the diameter of a pile of coins to be packaged so as to adjust the spacing between the cutter and a plurality of packaging rollers so that the cutting length of rolled packaging paper can be selected to a proper value, comprising: a drive roller supported in a manner to move together with said cutter, when the latter is moved, while maintaining its relative position to the same; and a follower roller made rotatable in a manner to follow said drive roller so as to unroll and let off the packaging paper toward said cutter in accordance with said drive roller.

BRIEF DESCRIPTION OF THE DRAWINGS

Other objects and advantages of the present invention will become apparent from the following description made in connection with the accompanying drawing, in which.

DESCRIPTION OF THE PREFERRED EMBODIMENT

Figure 1:
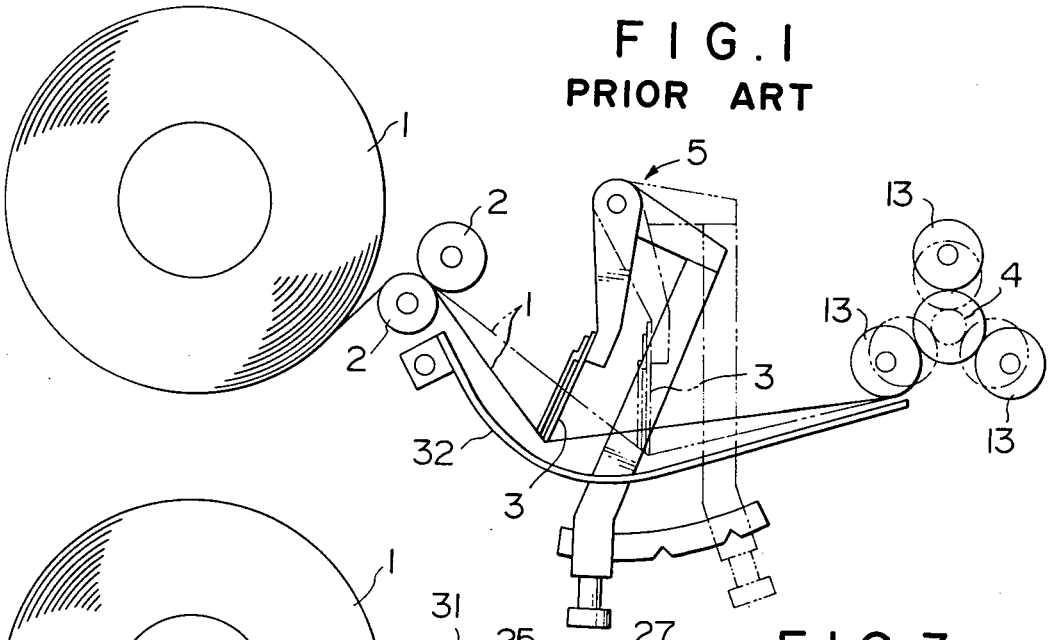
FIG. 1 PRIOR ART
FIG. 1 is a top plan view showing one of the conventional packaging paper cutting mechanism for use with a coin packaging machine with a view to illustrating the background of the present invention.

Before entering into the detailed description of the present invention, the drawback concomitant with the packaging paper cutting mechanism of a conventional coin packaging machine, which is contemplated to be eliminated by the present invention, will be shortly explained only for illustrative purposes with reference to FIG. 1. As shown, the packaging paper cutting mechanism is equipped with a pair of let-off rollers 2 which are made operative to let off a roll of packaging paper 1. The let-off rollers 2 are attached to the (not-shown) frame of the packaging machine in the vicinity of the rolled packaging paper 1 so that their let-off position of the packaging paper 1 is fixed at a preset position. As a result, when the position of a cutter 3 is shifted to adjust the cutting length of the packaging paper 1, the relative positions of the let-off rollers 2 to the cutter 3 are changed. More specifically, when the contact position between the packaging paper 1 and the cutter 3 is shifted toward a pile of coins 4 until it comes to a position shown in double-dotted lines, the cutting angle of the packaging paper 1 by the cutter 3 becomes more obtuse so that the packaging paper 1 cannot be cut in a satisfactory fashion.

Figure 3:
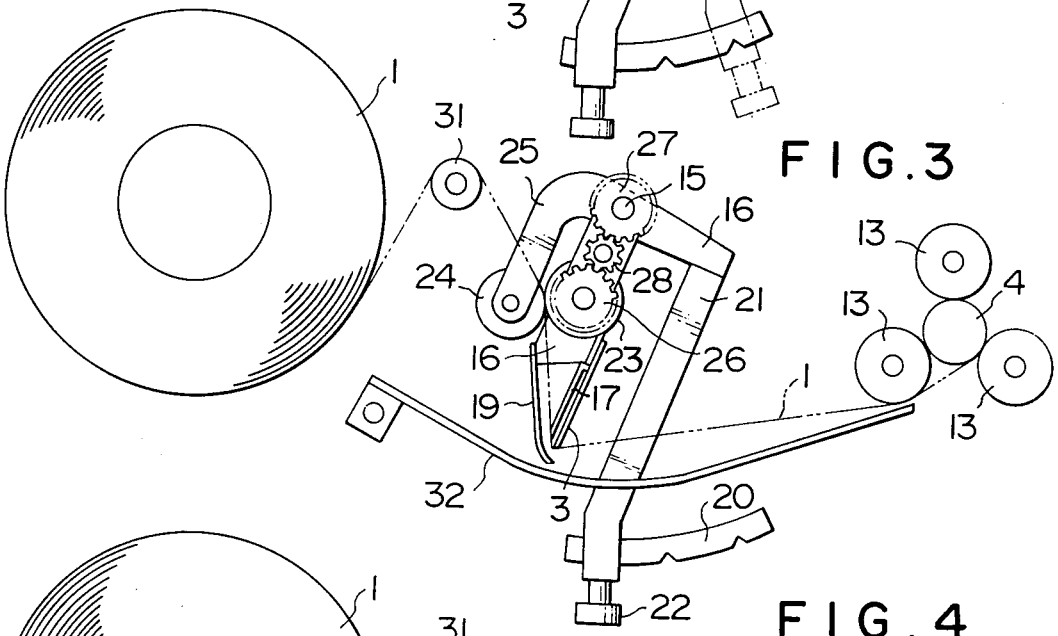
FIG. 3 is similar to FIG. 1 but shows the packaging paper cutting mechanism, as shown in FIG. 2, according to the present invention.
Figure 4:
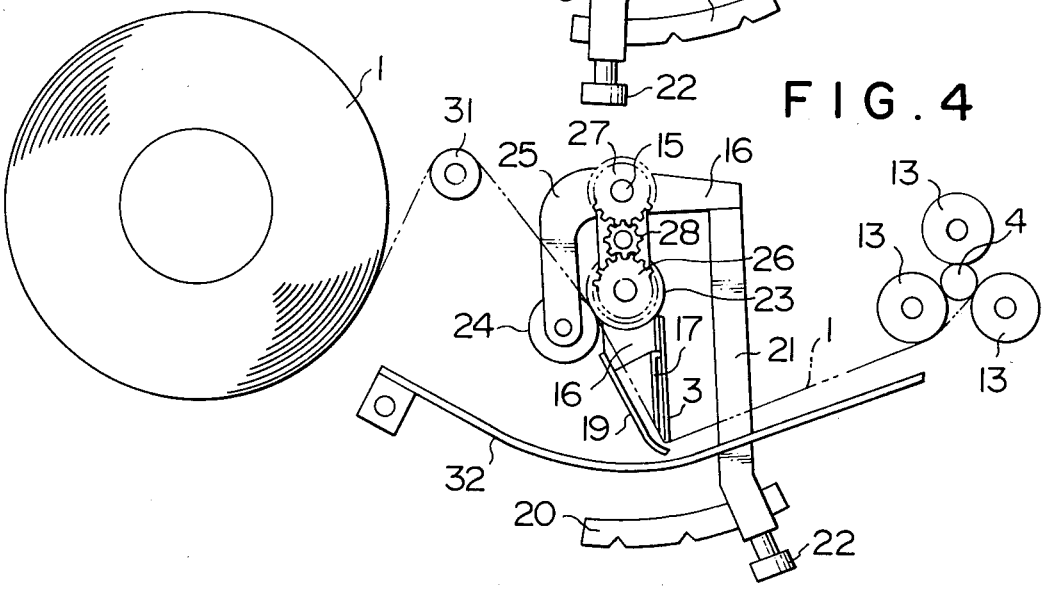
FIG. 4 is similar to FIG. 3 but shows the case, in which the size of coins to be packaged is reduced.
Figure 2:
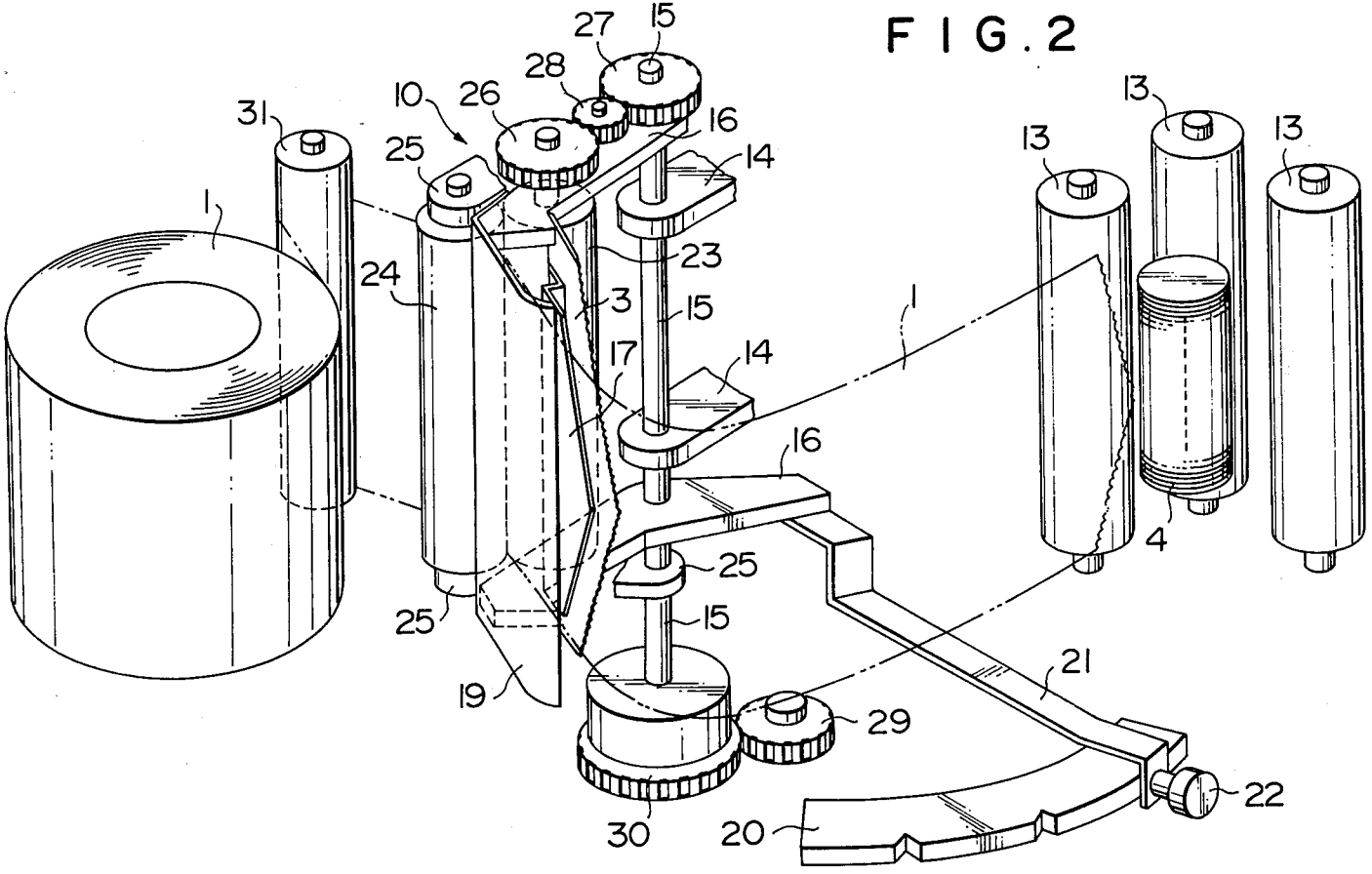
FIG. 2 is a simplified perspective view showing in an exploded manner a packaging paper cutting mechanism according to the present invention together with such essential portions of the coin packaging machine as are necessary for explaining the construction and operations of the packaging paper cutting mechanism of the present invention.

Turning now to FIGS. 2 to 4, the cutting mechanism in accordance with the present invention will be described in the following. Indicated at reference numeral 10 is a cutting mechanism exemplifying the present invention, which corresponds to the cutting mechanism 5 shown in FIG. 1. The cutting mechanism 10 is interposed between the rolled paper 1 and three packaging rollers 13. The cutting mechanism 10 has its shaft 15 rotatably supported on a pair of supporting members 14 which in turn are fixed to the (not-shown) body of the packaging machine. There are mounted rotatably to the upper and lower end portion of the shaft 15 a pair of rocking members 16, to the leading ends of which is fixed the cutter 3 carrying an auxiliary guide plate 17. There is also fixed to the leading ends of the rocking members 16 a guide plate 19 which is positioned at a slight spacing from the edge of the cutter 3. There is fixed to another leading of the lower rocking member 16 a rocking arm 21 which is made movable along a scale plate 20. The rocking arm 21 is equipped at its leading end with a knob 22.

A drive roller 23 is mounted rotatably between the rocking members 16 of the cutting mechanism 10. A follower roller 24 is mounted rotatably between a pair of arm members 25 which are also mounted rotatably to the upper and lower end portions of the shaft 15. The follower roller 24 thus mounted is biased into contact with the driver roller 23 by means of a not-shown spring so that the former roller 24 can be driven to rotate by the latter roller 23. A driven gear 26 is mounted to the upper end portion of the drive roller 23 and is driven by a drive gear 27 which in turn is mounted to the upper end portion of the shaft 15. An intermediate gear 28 is interposed in a meshing manner between the two gears 26 and 27. To the lower end portion of the shaft 15, on the other hand, there is mounted a driven gear 30 which is driven to rotate through an intermediate gear 29 by a driving power source such as a not-shown motor. Incidentally, reference numeral 31 indicates a guide roller which is operative to guide the packaging paper 11, when the latter is unrolled, to the cutting mechanism 10. Moreover, indicated at numeral 32 is a guide wall 32 which is positioned upright to guide the packaging paper 1 to the packaging rollers 13.

The operations of the cutting mechanism thus constructed will be described. At first, the packaging paper 1 is unrolled by progressively pulling its leading end and is threaded into the clearance between the drive roller 23 and the follower roller 24. The leading end of the unrolled paper 1 is further introduced into the clearance between the cutter 3 and the guide plate 19. After this preparation, when the piled coins 4 are fed to the space among the packaging rollers 13, the drive roller 23 is turned by the not-shown power source through the gears 29, 30, 27, 28 and 26 in this order. As a result, the packaging paper 1 is progressively let off, while being held between the drive roller 23 and the follower roller 24, so that it is guided by the guide wall 32 onto the piled coins 4. Then, the packaging paper 1 thus guided is wound on the outer circumferences of the piled coins 4 by the actions of the packaging rollers 13. After a preset time lapses, the driving power is interrupted to stop the drive roller 23 so that the let-off operation of the packaging paper 1 is interrupted. Since this paper 1 is held between the two rollers 23 and 24 and since the packaging rollers 13 still continue their rotational packaging operations, the packaging paper 1 is still held under tension by the pulling forces of the packaging rollers 13. As a result, the packaging paper is forced onto the edge of the cutter 3 until it is cut thereby. The packaging paper 1 thus cut is wound on the piled coins 4 and then is closed tight at its both side ends.

In case, therefore, it is intended to change the cutting length of the packaging paper 1 in accordance with the diameter of the piled coins 4, the rocking arm 21 is manually moved along the scale plate 20 to rock the lower rocking arm 16 about the shaft 15 so that the cutter 3 may be carried by the rocking members 16 until the cutter 3 is brought to such a preset position as can cut the packaging paper 1 to a preset length. While, the cutter 3 is carried, both rollers 23 and 24 are moved together. As a result, the packaging paper 1 is guided by the rollers 23 and 24 at a preset satisfactory angle with respect to the cutter 3 so that its cutting operation can be ensured irrespective of its cutting length.

In an alternative, the movement of the cutter may be accomplished in cooperation of a known money kind selecting handle which is operated when a desired kind of money is to be selected.

What is claimed is:

1. A packaging paper cutting mechanism for use with a coin packaging machine, and having a cutter setting position which is adaptable based on the diameter of coins to be packaged, comprising:

a pair of rocking members positioned apart from each other, a cutter mounted on said rocking members and having a setting position, a drive roller rotatably mounted on said rocking members, a follower roller mounted on said rocking members and operatively associated with said drive roller so as to cooperate therewith to feed the packaging paper between said drive roller and said following roller, and means for rocking said pair of rocking members so as to change the setting position of the cutter in accordance with the diameter of the coins to be packaged and to move the drive and followes rollers together with the cutter while maintaining their relative position the same.

2. A packaging paper cutting mechanism according to claim 1 wherein one of said rocking members has one leading end, and wherein said rocking means include a rocking arm fixed to said one leading end of said one of said rocking members.

3. A packaging paper cutting mechanism according to claim 1, wherein said cutter has an edge, said mechanism further comprising first guide means for guiding the leading end of the unrolled packaging paper onto the edge of said cutter.

4. A packaging paper cutting mechanism according to claim 3, wherein said first guide means includes a guide plate positioned at a slight spacing from the edge of said cutter.

5. A packaging paper cutting mechanism according to claim 1, further comprising packing rollers, and second guide means for guiding the unrolled packing paper to said packing rollers.

6. A packaging paper cutting mechanism according to claim 5, wherein the second guide means includes a guide wall positioned upright to extend between the edge of said cutter and said packing rollers.

7. A packaging paper cutting mechanism according to claim 1, further comprising gear train means for driving said drive roller.

* * * * *